US011628645B2

(12) United States Patent
Picchi et al.

(10) Patent No.: US 11,628,645 B2
(45) Date of Patent: Apr. 18, 2023

(54) DEVICE FOR MICRO-EMBOSSING OF PAPER AND PAPER PROCESSING LINE COMPRISING SAID DEVICE

(71) Applicant: GAMBINI S.P.A., Milan (IT)

(72) Inventors: Fabio Picchi, Lammari (IT); Giovanni Buffa, Ponte Buggianese (IT)

(73) Assignee: GAMBINI S.P.A., Milan (IT)

( * ) Notice: Subject to any disclaimer, the term of this patent is extended or adjusted under 35 U.S.C. 154(b) by 477 days.

(21) Appl. No.: 16/621,121

(22) PCT Filed: Jun. 13, 2018

(86) PCT No.: PCT/IB2018/054311
§ 371 (c)(1),
(2) Date: Dec. 10, 2019

(87) PCT Pub. No.: WO2018/229676
PCT Pub. Date: Dec. 20, 2018

(65) Prior Publication Data

US 2020/0324506 A1 Oct. 15, 2020

(30) Foreign Application Priority Data

Jun. 14, 2017 (IT) ..... 102017000065732

(51) Int. Cl.
*B31F 1/07* (2006.01)
*B65H 16/00* (2006.01)
(Continued)

(52) U.S. Cl.
CPC ..... *B31F 1/07* (2013.01); *B65H 16/00* (2013.01); *B65H 18/08* (2013.01); *B65H 37/04* (2013.01);
(Continued)

(58) Field of Classification Search
CPC ..... B31F 1/07; B31F 2201/0743; B31F 2201/0753; B31F 2201/0756;
(Continued)

(56) References Cited

U.S. PATENT DOCUMENTS 1,964,312 A 6/1934 Bright
2,018,244 A 10/1935 Alm
(Continued)

FOREIGN PATENT DOCUMENTS

EP 3 037 253 A1 6/2016
JP 2007-209657 A 8/2007
(Continued)

OTHER PUBLICATIONS

Office Action dated Jan. 4, 2022 in corresponding Japanese Patent Application No. 2019-568610 (with English Translation), 5 pages.
(Continued)

*Primary Examiner* — Eric Hug
*Assistant Examiner* — Matthew M Eslami
(74) *Attorney, Agent, or Firm* — Oblon, McClelland, Maier & Neustadt, L.L.P.

(57) ABSTRACT

A device for micro-embossing paper includes at least one micro-embossing unit to micro-emboss a wet paper ply. The micro-embossing unit includes a micro-embossing cylinder and a counter cylinder facing the micro-embossing cylinder at an embossing area where the wet paper ply is subjected to micro-embossing, and a heater to dry the wet paper ply. The micro-embossing cylinder includes a side surface partially
(Continued)

wrapped by the wet paper ply. The heater heats at least one portion of the side surface partially wrapped by the wet paper ply to dry the wet paper ply.

12 Claims, 4 Drawing Sheets

(51) Int. Cl.

| | |
|---|---|
| ***B65H 18/08*** | (2006.01) |
| ***B65H 37/04*** | (2006.01) |
| ***D21F 3/02*** | (2006.01) |
| ***D21F 3/08*** | (2006.01) |
| ***D21F 11/00*** | (2006.01) |
| ***D21H 27/02*** | (2006.01) |

(52) U.S. Cl.
CPC ..... *D21F 3/0281* (2013.01); *D21F 3/086* (2013.01); *D21F 11/006* (2013.01); *D21H 27/02* (2013.01); *B31F 2201/0743* (2013.01); *B31F 2201/0753* (2013.01); *B31F 2201/0756* (2013.01); *B31F 2201/0771* (2013.01); *B31F 2201/0782* (2013.01); *B31F 2201/0784* (2013.01)

(58) Field of Classification Search
CPC ..... B31F 2201/0771; B31F 2201/0782; B31F 2201/0784; B31F 2201/0715; B65H 16/00; B65H 18/08; B65H 37/04; D21F 3/0281; D21F 3/086; D21F 11/006; D21H 27/02
See application file for complete search history.

(56) References Cited

U.S. PATENT DOCUMENTS

| | | | | |
|---|---|---|---|---|
| 2,091,572 | A | | 8/1937 | Swan, III |
| 5,007,271 | A | | 4/1991 | Boegli |
| 5,862,750 | A | * | 1/1999 | Dell'Olmo ..... B44C 1/24 101/27 |
| 6,913,673 | B2 | | 7/2005 | Baggot et al. |
| 2006/0037724 | A1 | | 2/2006 | Akai et al. |
| 2006/0243383 | A1 | | 11/2006 | Gelli et al. |
| 2006/0278357 | A1 | | 12/2006 | Suzuki et al. |
| 2009/0126885 | A1 | | 5/2009 | Akai et al. |
| 2009/0134534 | A1 | | 5/2009 | Koivukunnas et al. |
| 2011/0020605 | A1 | | 1/2011 | Suzuki et al. |
| 2017/0282635 | A1 | | 10/2017 | Boegli et al. |

FOREIGN PATENT DOCUMENTS

| | | | | |
|---|---|---|---|---|
| JP | 2007-331394 | A | | 12/2007 |
| JP | 2015-74098 | A | | 4/2015 |
| JP | 2015074098 | A | * | 4/2015 |
| WO | WO 2006/133389 | A2 | | 12/2006 |

OTHER PUBLICATIONS

Communication of a notice of opposition issued Feb. 28, 2022 in European Patent Application No. 18737992.0, 23 pages.
International Search Report dated Nov. 30, 2018 in PCT/IB2018/054311 filed on Jun. 13, 2018.

* cited by examiner

DEVICE FOR MICRO-EMBOSSING OF PAPER AND PAPER PROCESSING LINE COMPRISING SAID DEVICE

The present invention relates to a device for the micro-embossing of paper, in particular "tissue" type paper, and a paper processing line comprising said device.

It is currently known, for example from patent no. EP1731296B1, that rolls of "tissue" type paper are made through a method of micro-embossing paper plies that have been previously wet or onto which a lotion with a wetting effect has been previously applied. The term micro-embossing means that the paper plies are embossed through a micro-embossing cylinder, and the related counter cylinder, which has reliefs substantially equally distributed on its side surface, where the reliefs have heights generally less than half a millimetre. Micro-embossing is therefore distinguished from traditional embossing in the general sense, which involves the performance, through embossing profiles, of embossings with greater heights and generally having patterns that also have an aesthetic effect.

It has been found that the "tissue" paper obtained by subjecting one or more of the plies that comprise it to such a micro-embossing method allows the thickness of the paper itself to be increased, however also reducing the softness perceived by the final user.

The micro-embossing method mentioned above substantially envisages wetting, or humidifying, one or more paper plies before their embossing with a micro-embossing cylinder and then drying such plies to remove the residual water present, and thus obtaining a roll of micro-embossed paper generally comprising numerous plies, which can be subsequently used in "tissue" paper processing lines for obtaining the final product, such as so-called "converting" lines.

However, the micro-embossing method mentioned above, and described in patent no. EP1731296B1, has significant technical drawbacks mainly connected with the complexity and slowness of the operations to be performed in order to reach, starting from one or more paper plies, the formation of rolls of "tissue" paper having the desired resistance and softness properties, and therefore the final product that can be obtained starting from such rolls.

The main task of the present invention consists of realising a device for the micro-embossing of paper that overcomes the drawbacks of the prior art allowing the micro-embossing of the paper to be performed within the paper processing line itself.

Within the context of this task, an object of the present invention is to realise a device for the micro-embossing of paper that can operate at micro-embossing speeds compatible with the production speeds of the paper processing lines.

The main aim is to emboss the paper increasing its thickness considerably without deteriorating the characteristics of the paper itself (mechanical resistance and absorbency)

Another object of the invention consists of realising a device for the micro-embossing of paper that allows the undesired production of paper dust to be reduced in a converting line.

Yet another object of the invention consists of realising a device for the micro-embossing of paper that allows the paper to be wet with perfumed and/or sanitising lotions.

A further object of the invention consists of realising a device for the micro-embossing of paper that can provide the widest reliability and safety guarantees during use.

Yet another object of the invention consists of realising a device for the micro-embossing of paper that is both easy to realise and economically competitive compared with the prior art.

The task set forth above, as well as the mentioned objects and others that will appear more clearly below, are reached by a device for the micro-embossing of paper as set forth in claim 1.

Other characteristics are envisaged in the dependent claims.

Additional features and advantages will become more apparent from the description of a preferred, but non-exclusive, embodiment of a device for the micro-embossing of paper, illustrated by way of non-limiting example with the aid of the appended drawings, in which.

Figure 2:
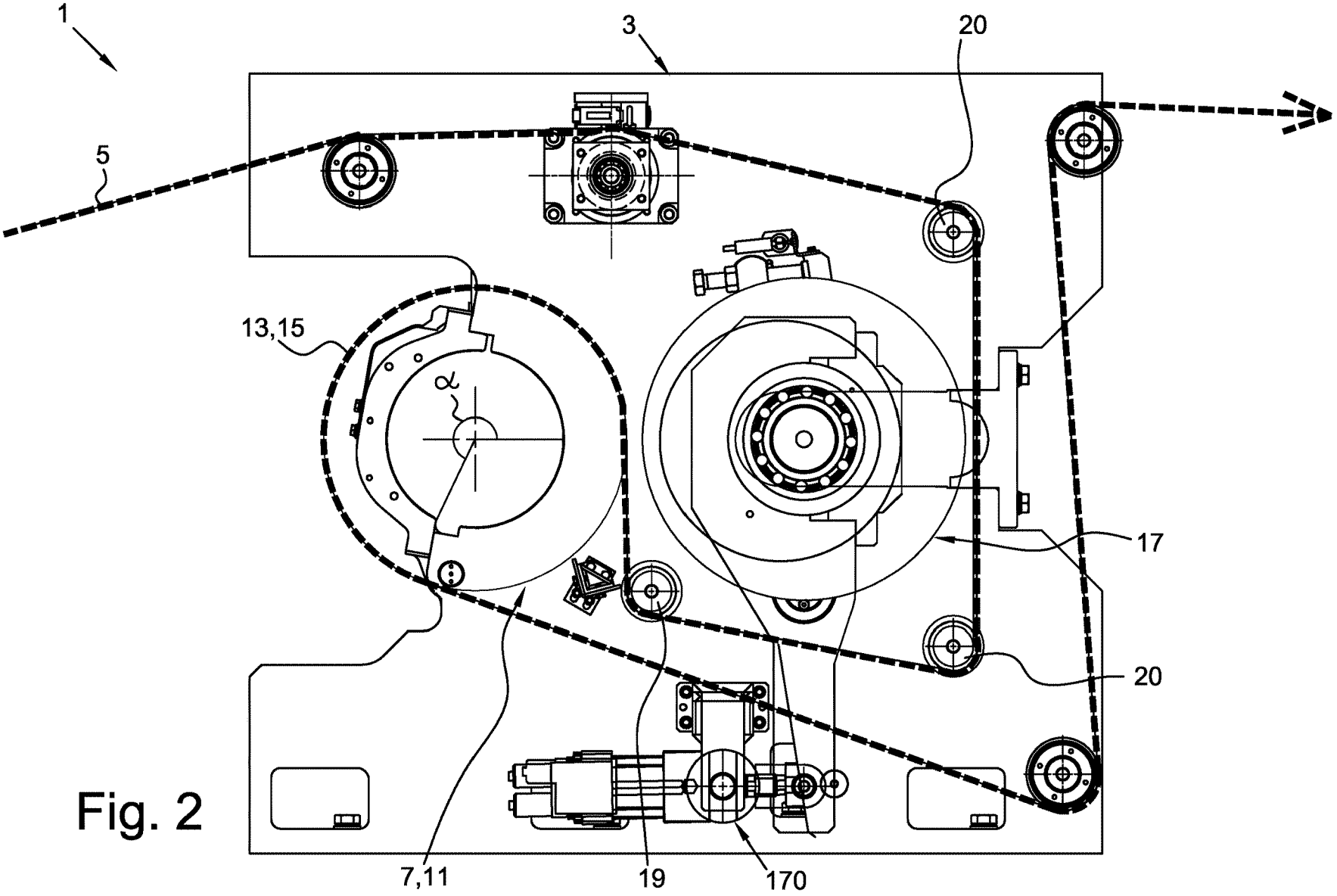
FIG. 2 is a schematic view of a device for the micro-embossing of paper, according to the invention.
Figure 4:
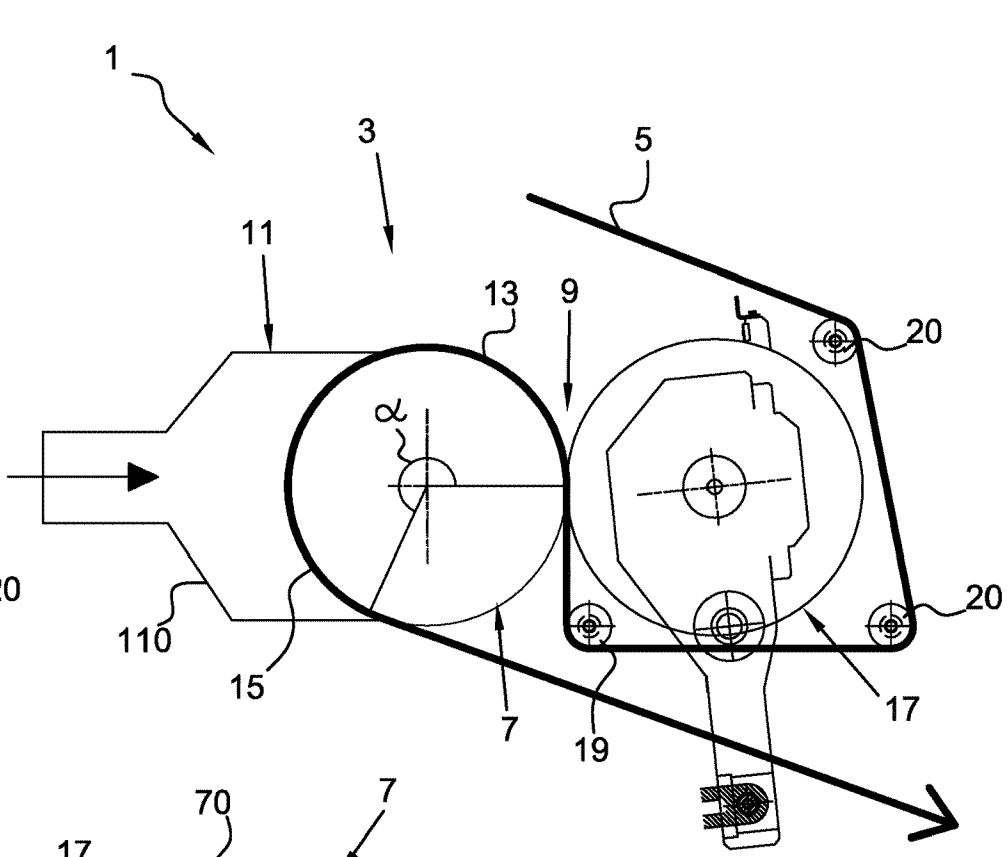
Figure 3:
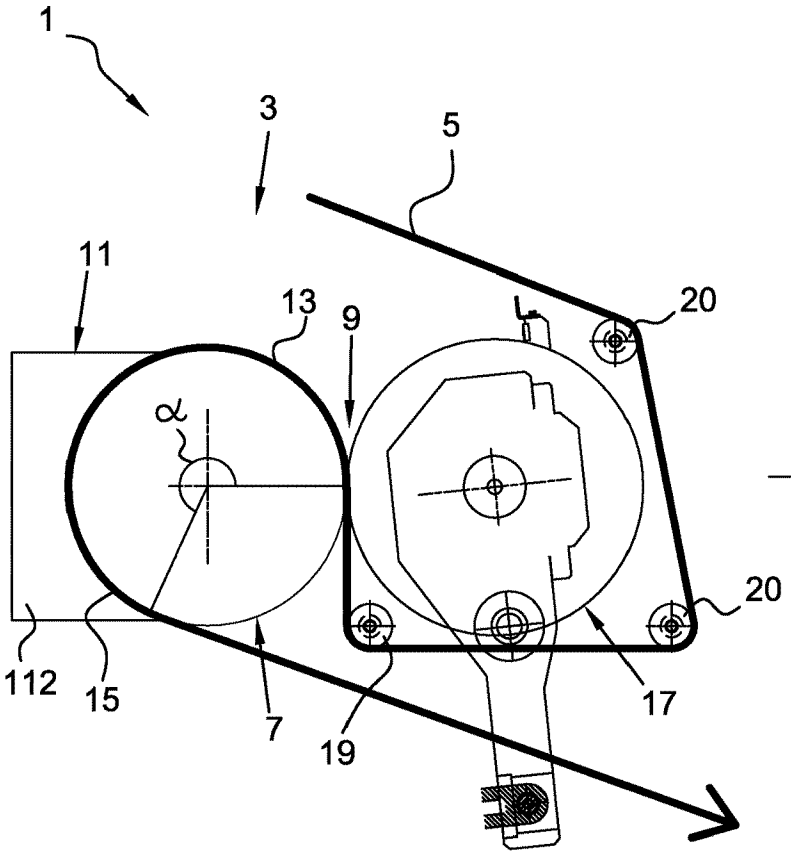
Figure 6:
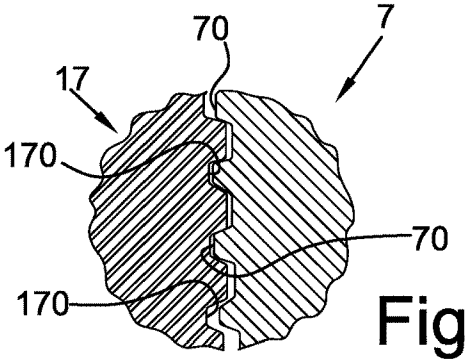
Figure 5:
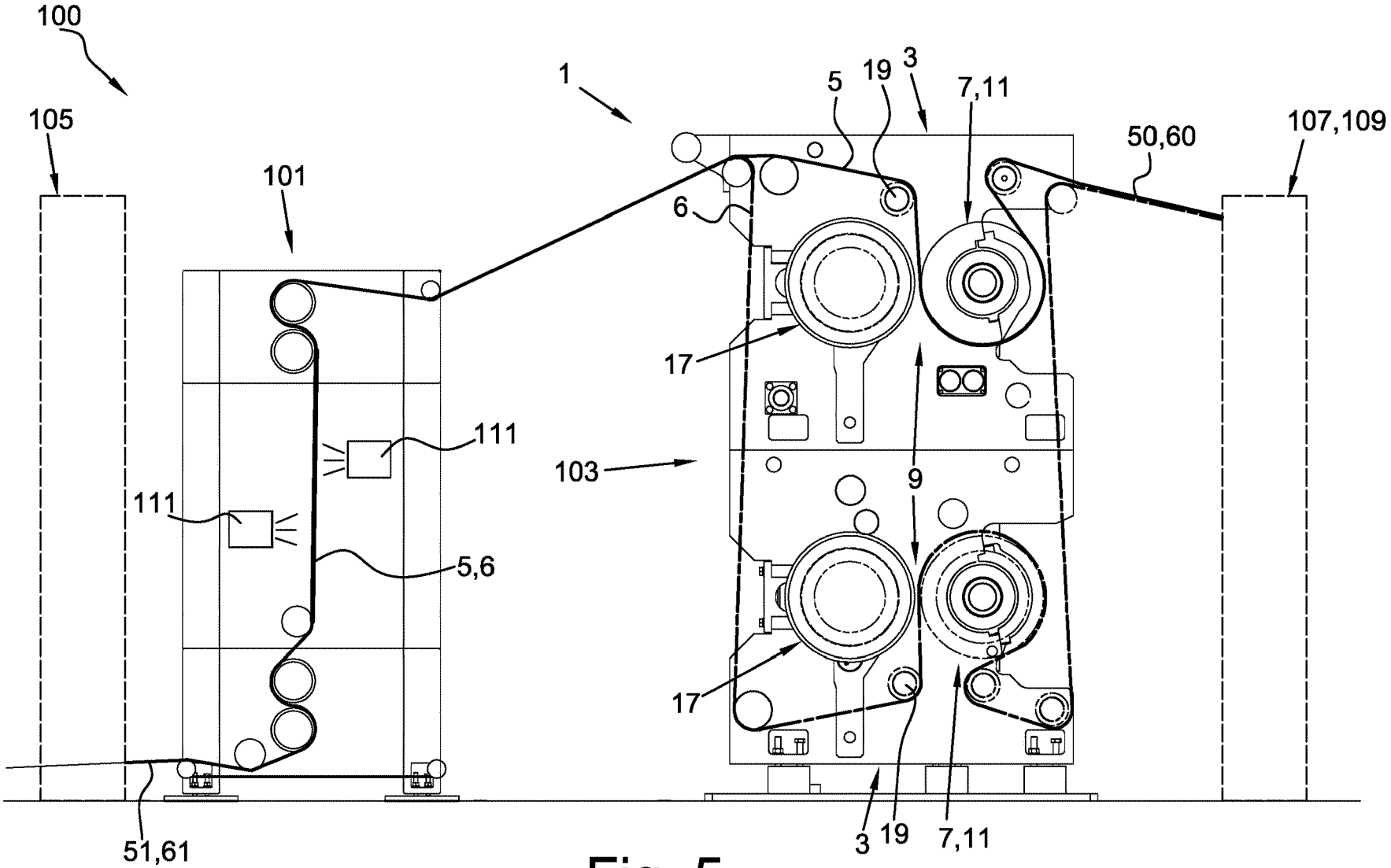

FIGS. 3 and 4 relate to two variants of the device for the micro-embossing of paper of FIG. 2, and schematically illustrate the main components of such two variants, according to the invention;

FIG. 5 is a schematic view of a part of a paper processing line that comprises a device for the micro-embossing of paper, in a further variant, according to the invention;

FIG. 6 schematically illustrates a detail of the processing cylinders according to a further variant of the device for the micro-embossing of paper, according to the invention.

With reference to the mentioned figures, the device for the micro-embossing of paper, indicated overall with the reference number 1, comprises at least one micro-embossing unit 3 configured to micro-emboss a wet paper ply 5, 6. Such micro-embossing unit 3 comprises:

- a micro-embossing cylinder 7 and a counter cylinder 17 facing the micro-embossing cylinder 7 at an embossing area 9 where such wet paper ply 5, 6 is subjected to micro-embossing, and
- heating means 11 configured to dry the wet paper ply 5, 6.

According to the invention, the micro-embossing cylinder 7 comprises a side surface 13 partially wrapped by said wet paper ply 5, 6. Furthermore, the heating means 11 are configured to heat at least one portion 15 of said side surface 13 partially wrapped by the wet paper ply 5, 6 to dry such wet paper ply 5, 6.

The micro-embossing unit 3 comprises at least one motorised return roller 19, 20 configured to ensure that the contact of the wet paper ply 5, 6 with the counter cylinder 17 occurs exclusively at the embossing area 9.

Advantageously the return roller 19, 20 allows the wet paper ply 5, 6 to enter into contact only tangentially with the counter cylinder 17.

The side surface 13 of the micro-embossing cylinder 7 is advantageously wrapped by the wet paper ply 5, 6 over a wrapping angle a greater than 45°, preferably comprised between 120° and 300°, and even more preferably comprised between 180° and 270°.

Advantageously the side surface 13 of the micro-embossing cylinder 7 is wrapped by the wet paper ply 5, 6 over a wrapping angle a greater than 210°.

For example, as illustrated in FIGS. 2, 3 and 4, the wrapping angle a of the wet paper ply 5 around the micro-embossing cylinder 7 is substantially equal to 270°.

The heating means 11 can be housed inside the micro-embossing cylinder 7 and can therefore be configured to heat from within the side surface 13 of the micro-embossing cylinder 7.

Alternatively, the heating means 11 can be housed outside the micro-embossing cylinder 7 and can therefore face the side surface 13 of the micro-embossing cylinder 7, heating the heated portion 15 thereof.

Advantageously heating means can be provided acting both from inside and from outside the micro-embossing cylinder 7.

The heating means 11 housed inside the micro-embossing cylinder 7 are advantageously adapted to heat, by conduction, the whole micro-embossing cylinder 7. Therefore, the whole portion of the wet paper ply 5, 6 that wraps the micro-embossing cylinder 7 is heated.

The heating means 11 housed outside the micro-embossing cylinder 7 are advantageously adapted to heat, by radiation and/or convection, a portion 15 of the wet paper ply 5, 6 wrapped around the micro-embossing cylinder 7. However, also in this case, the heat also tends to reach the micro-embossing cylinder 7, which tends to heat up and therefore to heat the wet paper ply 5, 6 which is wrapped around the micro-embossing cylinder 7 itself. Therefore, the heating of the wet paper ply 5, 6 does not necessarily take place exclusively at the heated portions 15 thereof that face the heating means 11.

The heating means 11 can comprise an electrical resistor, appropriately embedded in the micro-embossing cylinder 7, or an oil, water or steam heating circuit, also at least partially obtained inside the micro-embossing cylinder 7 itself.

The micro-embossing cylinder 7 is advantageously made of steel-like material.

A coil can be inserted into the micro-embossing cylinder 7 inside which oil circulates at a controlled temperature, supplied by a pumping and heating system, which can also reside outside the device 1.

As illustrated schematically in FIG. 3, the heating means 11 can comprise an electromagnetic induction heater 112.

As illustrated schematically in FIG. 2, the heating means 11 can comprise a hood 110 conveying a flow of hot air onto the heated portion 15 of the side surface 13 of the micro-embossing cylinder 7. Advantageously the hood 110 affects a sufficiently extended surface area of the side surface 13 of the micro-embossing cylinder 7, to ensure sufficient delivery of heat to dry the wet paper ply 5, 6.

For example, the hood 110 can affect an angular surface of the embossing cylinder 7 according to an angle comprised between 30° and 270°, and preferably about 180°.

Advantageously, the device for the micro-embossing of paper 1 comprises a plurality of said micro-embossing units 3 adapted to operate in parallel.

Figure 1:
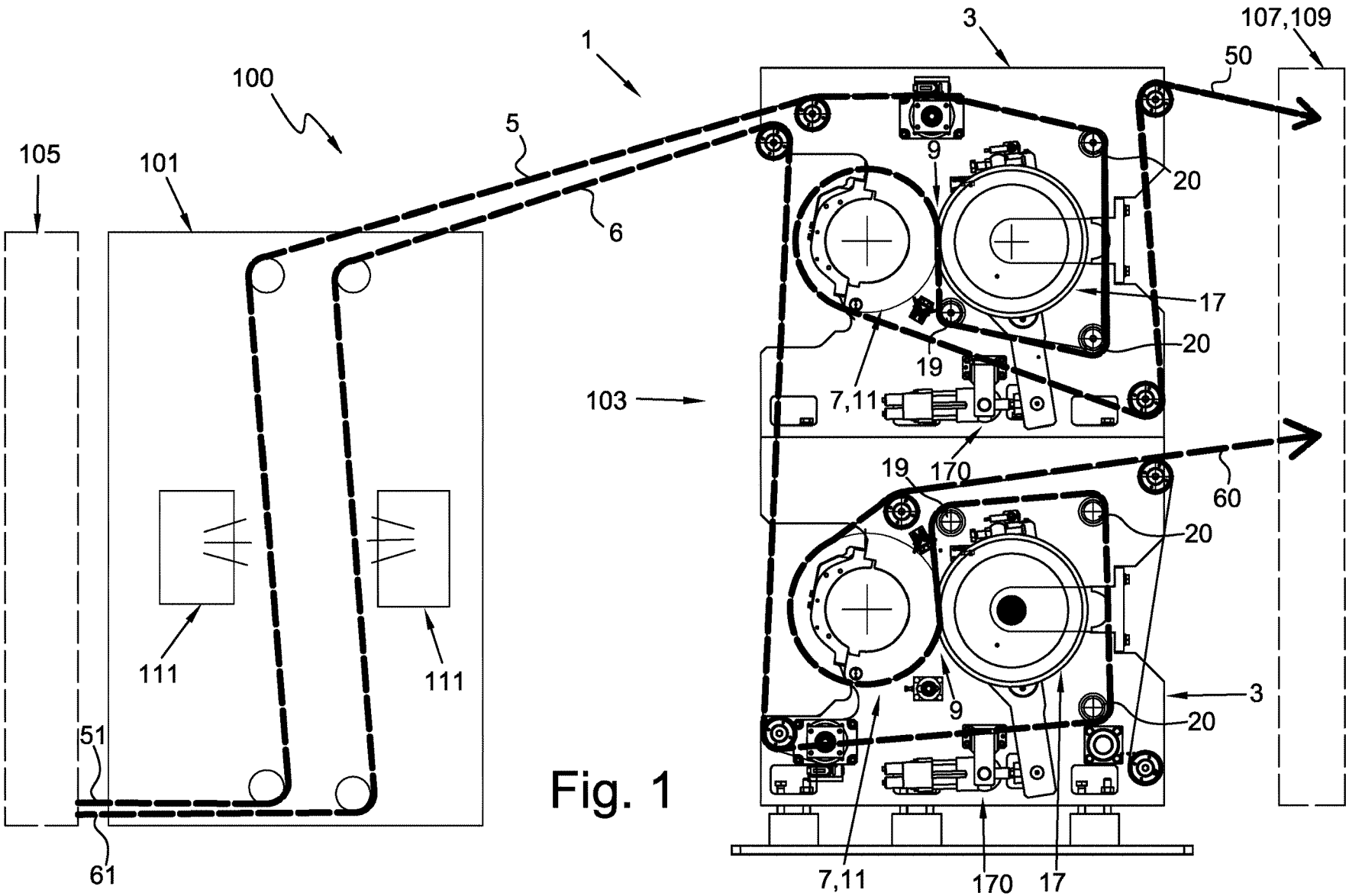
FIG. 1 is a schematic view of a part of a paper processing line that comprises a device for the micro-embossing of paper, according to the invention.

For example, FIGS. 1 and 5 illustrate devices for micro-embossing 1 that comprise two micro-embossing units 3 reciprocally superposed and configured to micro-emboss two distinct wet paper plies 5 and 6 in parallel.

The counter cylinder 17 may be a cylinder made of a rubber type material. Such counter cylinder 17 is configured to press, at the embossing area 9, against a micro-embossing cylinder 7 in order to micro-emboss the wet paper ply 5, 6 which is interposed between the cylinder 7 and the counter cylinder 17.

The counter cylinder 17 may be associated with a mechanism 170 adapted to vary the distance of the centre of the counter cylinder 17 from the centre of the micro-embossing cylinder 7, both to move the counter cylinder 17 away from the cylinder 7, as illustrated by way of example in FIG. 2, and to vary the co-penetration between the rubber counter cylinder 17 and the micro-embossing cylinder 7.

Advantageously, as schematically illustrated in the enlargement shown in FIG. 6, the counter cylinder comprises on its side surface a plurality of incisions 170 configured for coupling with the micro-embossing reliefs 70 present on the micro-embossing cylinder 7, according to a male/female coupling.

Advantageously, the counter cylinder 17 is activated in rotation in a synchronised way with the rotation of the micro-embossing cylinder 7.

Advantageously, the counter cylinder 17 is activated in rotation through gears that draw the rotation motion from the micro-embossing cylinder 7.

The presence of male/female incisions/reliefs between the steel micro-embossing cylinder 7 and the rubber counter cylinder 17, allows the embossing pressure to be reduced between the cylinder 7 and the counter cylinder 17 which, in the case of wet and heated paper, notably reduces the harmful effects caused by traditional embossing.

Advantageously, the micro-embossing unit 3 comprises a plurality of return rollers 19, 20 arranged around the counter cylinder 17 to prevent contact of the wet paper ply 5, 6 with the counter cylinder 17 except at the embossing area 9.

According to the path performed by the paper ply, and according to the arrangement of the micro-embossing cylinder 7 and the counter cylinder 17 a single return roller 19 may be sufficient, such as in the example of FIG. 5 or, as illustrated in the example of FIG. 1, to prevent contact of the paper ply 5, 6 with the counter cylinder 17, the individual return roller indicated with the reference number 19 in proximity to the embossing area 9 may not be sufficient, and therefore further embossing rollers must be provided indicated with the reference number 20.

It has been observed that the rubber cylinders, co-penetrating into steel micro-embossing cylinders in the reciprocal contact point tend to assume a lower rotation speed than the steel cylinder itself. In the event that the paper ply is partially wrapped around the rubber cylinder, such difference in speed between the two cylinders implies the elongation and therefore the stretching of the paper ply, with a consequent thinning of the thickness of the paper ply. Such a phenomenon is even more accentuated the greater the rotation speed of the two cylinders. Such stretching of the paper ply is particularly harmful for the paper that has just been humidified and it is in a very easily deformable state.

Therefore the presence of return rollers 19, 20 able to prevent the contact of the wet paper ply 5, 6 with the counter cylinder 17 except in the point of contact with the micro-embossing cylinder 17, in the embossing area 9, drastically reduces such a harmful effect on the wet paper.

Advantageously, all the return rollers 19, 20 can be motorised.

The fact that at least one return roller 19, or all the return rollers 19, 20 present are motorised rollers further reduces the risks of the wet paper ply 5, 6 undergoing undesired stretching in the path towards the device 1, up to the embossing area 9.

Advantageously, the micro-embossing cylinder 7 has a plurality of reliefs substantially equally distributed around the lateral surface 13 of the cylinder 7 itself, where such reliefs have a thickness of less than 1 millimetre, and preferably less than 0.5 millimetres.

Advantageously such reliefs can be truncated pyramid shaped or have a truncated cone shaped section. The number of reliefs present on the micro-embossing cylinder can be advantageously comprised between 60 and 100 reliefs per square centimetre.

Advantageously, the axes of rotation of the micro-embossing cylinder 7 and the counter cylinder 17, respectively, lie in the same substantially horizontal plane. The horizontal arrangement of the cylinder 7 and the counter cylinder 17 advantageously allows the vertical dimensions of the device 1 to be reduced.

In this way, it is possible to vertically superpose two or more devices for the micro-embossing of paper 1.

The present invention also relates to a paper processing line 100, or a converting line, comprising:

- an unwinding station 105 for unwinding at least two paper plies 51, 61;
- a wetting station 101 for wetting at least one of such two paper plies 51, 61, adapted to wet said at least one paper ply 51, 61 to obtain at least one wet paper ply 5, 6;
- a micro-embossing station 103 for micro-embossing said at least one wet paper ply 5, 6, comprising a device for the micro-embossing of paper 1 as described above, adapted to micro-emboss said at least one wet paper ply 5, 6 to obtain at least one micro-embossed paper ply 50, 60;
- a joining station 107 for joining said at least one micro-embossed paper ply 50, 60 with a second micro-embossed paper ply 50, 60 or with one paper ply 51, 61, to obtain a paper with multiple plies at least one of which is micro-embossed;
- a rewinding station 109 for rewinding such multi-ply paper, for forming a roll of paper known as a "log".

Advantageously the paper plies 51, 61 can be unwound, in the unwinding station 105, starting from a pair of single ply rolls or starting from a double ply roll.

The wetting station 101 may comprise any wetting unit 111 able to wet the paper plies 51, 61.

For example, a nozzle system or a dosing roller system may be provided.

Advantageously the wetting unit 111 is configured to wet the face of the paper ply 51, 61 which is intended to face the micro-embossing cylinder 7.

Advantageously, the wetting station 105 can provide further systems for the application of perfumed and/or sanitizing lotions.

The joining station 107 may comprise a laminating unit adapted to join the paper plies 50, 60. Alternatively to the use of glue, the join between the two paper plies 50, 60 may be performed with mechanical systems, such as ply bonding systems.

Advantageously, in the event that the paper plies are not to be micro-embossed, the wetting station 101 and the micro-embossing station 103 can be deactivated. In this case the paper plies follow the envisaged paper passage but are not wet by the wetting unit 111 and are neither micro-embossed by the micro-embossing cylinder 7, e.g. by moving away the counter cylinder 17, nor heated.

Advantageously, it is possible to deactivate the wetting station 101 only, as well as the heating means 11, in order to perform a traditional type of micro-embossing, i.e. dry.

In the rewinding station 109 all the necessary operations for reaching the final product can be performed, in line, starting from a paper with multiple plies, of which at least one of the plies has been micro-embossed with the micro-embossing device as described.

The plies at the outlet from the device 1 can be supplied to a traditional embossing station, if present, or directly reach the rewinding station 109.

The present invention also relates to a method for the micro-embossing of paper comprising the steps of:

- wetting at least one paper ply 51, 61 to obtain at least one wet paper ply 5, 6;
- embossing said at least one wet paper ply 5, 6 between a micro-embossing cylinder 7 and a counter cylinder 17 in an embossing area 9;
- heating said at least one wet paper ply 5, 6 to dry said at least one wet paper ply 5, 6;

According to the invention, the method comprises the steps of:

- at least partially wrapping said at least one wet paper ply 5, 6 around the side surface 13 of the micro-embossing cylinder 7;
- heating at least one portion 15 of the side surface 13 partially wrapped by said wet paper ply 5, 6 to dry said wet paper ply 5, 6;
- returning said at least one wet paper ply 5, 6 by means of at least one motorised return roller 19, 20 to ensure that the contact of said at least one wet paper ply 5, 6 with said counter cylinder 17 occurs exclusively at said embossing area 9.

The side surface 13 of the micro-embossing cylinder 7 is advantageously wrapped by the wet paper ply 5, 6 over a wrapping angle a greater than 45°, and preferably comprised between 120° and 300°.

The device for the micro-embossing of paper according to the present invention has the advantage of being able to micro-emboss, and particularly dry, the wet paper plies effectively even at high production speeds, such as production speeds in the order of 500 metres per minute and up to 900 metres per minute.

In particular, the wet paper ply that has just been embossed remains in contact with the heating element, such as the micro-embossing cylinder itself, for a sufficiently long time to allow the drying of the ply itself, but without reducing the processing speed of the paper. In fact, the time during which the wet paper ply remains in contact with the heating element depends on the size of the wrapping of paper around the micro-embossing cylinder that is heated. The greater the extension of such wrapping, the greater the processing speed that can be ensured while maintaining the efficiency of the drying process of the wet paper ply just embossed.

In particular, the micro-embossing device allows the paper to be micro-embossed at compatible production speeds with the paper processing speeds in the converting lines, and therefore it can be inserted directly in the converting line itself.

In this way it is possible to directly equip the converting lines of such a micro-embossing device directly, without necessarily having to provide a specific micro-embossing device for the realisation of rolls of micro-embossed paper to be processed in the converting lines.

Yet another advantage of the invention consists of the fact that the wet paper ply is heated, and therefore dried, as soon as the micro-embossing has been performed, preventing the risks of the just embossed paper, that is still wet, being able to lose the micro-embossing effect.

The device for the micro-embossing of paper as conceived herein is susceptible to many modifications and variations, all falling within the invention; furthermore, all the details are replaceable by technically equivalent elements. In practice, the materials used, as well as their dimensions, can be of any type according to the technical requirements.

The invention claimed is:

1. A device for micro-embossing paper, comprising:

at least one micro-embossing unit configured to micro-emboss a wet paper ply, said micro-embossing unit comprising:

a steel micro-embossing cylinder and a rubber counter cylinder facing said steel micro-embossing cylinder at an embossing area where said wet paper ply is subjected to micro-embossing, and heating means configured to dry said wet paper ply, wherein said steel micro-embossing cylinder comprises a side surface partially wrapped by said wet paper ply over a wrapping angle comprised between 120° and 300°, wherein said heating means are configured to heat at least one portion of said side surface partially wrapped by said wet paper ply to dry said wet paper ply, wherein said at least one micro-embossing unit comprises at least one motorised return roller, and a path of said at least one wet paper ply being in contact with said rubber counter cylinder exclusively at said embossing area, and wherein axes of rotation of said steel micro-embossing cylinder and said rubber counter cylinder lie in a same substantially horizontal plane.

2. The device for the micro-embossing of paper according to claim 1, wherein said side surface is wrapped by said wet paper ply over a wrapping angle comprised between 180° and 270°.

3. The device for the micro-embossing of paper according to claim 1, wherein said side surface is wrapped by said wet paper ply over a wrapping angle greater than 210°.

4. The device for the micro-embossing of paper according to claim 1, wherein said heating means are housed inside said steel micro-embossing cylinder and are configured to heat from within said side surface of said steel micro-embossing cylinder.

5. The device for the micro-embossing of paper according to claim 1, wherein said heating means are housed outside said steel micro-embossing cylinder and face said side surface of said steel micro-embossing cylinder to heat said heated portion of said side surface partially wrapped by said wet paper ply.

6. The device for the micro-embossing of paper according to claim 1, wherein said heating means comprise an electrical resistor, or an oil, water or steam heating system, or an electromagnetic induction heater, or a hood conveying a flow of hot air.

7. The device for the micro-embossing of paper according to claim 1, further comprising a plurality of said micro-embossing units adapted to operate in parallel.

8. The device for the micro-embossing of paper according to claim 1, wherein said rubber counter cylinder comprises on the side surface a plurality of incisions configured to be coupled to micro-embossing reliefs present on said steel micro-embossing cylinder.

9. The device for the micro-embossing of paper according to claim 1, wherein said rubber counter cylinder is activated in rotation in a synchronised way with the rotation of said steel micro-embossing cylinder.

10. The device for the micro-embossing of paper according to claim 1, wherein said rubber counter cylinder is activated in rotation by gears that draw the rotation motion from said steel micro-embossing cylinder.

11. A paper processing line comprising:

an unwinding station for unwinding at least two paper plies;

a wetting station for wetting at least one of said at least two paper plies, adapted to wet said at least one paper ply to obtain at least one wet paper ply;

a micro-embossing station for micro-embossing said at least one wet paper ply, comprising the device for the micro-embossing of paper according to claim 1, configured to micro-emboss said at least one wet paper ply to obtain at least one micro-embossed paper ply;

a joining station for joining said at least one micro-embossed paper ply with a second micro-embossed paper ply or with said at least one paper ply, to obtain a paper with multiple plies at least one of which is micro-embossed; and a rewinding station for rewinding said multi-ply paper.

12. A method for the micro-embossing of paper comprising:

wetting at least one paper ply to obtain at least one wet paper ply;

embossing said at least one wet paper ply between one steel micro-embossing cylinder and a rubber counter cylinder in an embossing area;

heating said at least one wet paper ply to dry said at least one wet paper ply;

at least partially wrapping said at least one wet paper ply around the side surface of said steel micro-embossing cylinder over a wrapping angle comprised between 120° and 300°;

heating at least one portion of said side surface partially wrapped by said wet paper ply to dry said wet paper ply; and returning said at least one wet paper ply by at least one motorised return roller and contacting said at least one wet paper ply with said rubber counter cylinder exclusively at said embossing area, wherein axes of rotation of said steel micro-embossing cylinder and said rubber counter cylinder lie in a same substantially horizontal plane.

* * * * *